United States Patent [19]

Fukuchi

[11] Patent Number: 5,055,881

[45] Date of Patent: Oct. 8, 1991

[54] DEVICE FOR SUPPLYING A TONER TO A DEVELOPING UNIT

[75] Inventor: Yutaka Fukuchi, Tokyo, Japan

[73] Assignee: Ricoh Company, Ltd., Tokyo, Japan

[21] Appl. No.: 565,064

[22] Filed: Aug. 10, 1990

[30] Foreign Application Priority Data

Aug. 19, 1989 [JP] Japan ..... 1-96967[U]

[51] Int. Cl.[5] ..... G03G 21/00

[52] U.S. Cl. ..... 355/260; 355/208; 355/246

[58] Field of Search ..... 355/208, 246, 260

[56] References Cited

U.S. PATENT DOCUMENTS 4,720,730 7/1988 Ito ..... 355/246 X 4,758,861 7/1988 Nakamaru et al. ..... 355/246 X

FOREIGN PATENT DOCUMENTS 61-59471 3/1986 Japan ..... 355/246

*Primary Examiner*—A. T. Grimley

*Assistant Examiner*—P. J. Stanzione

*Attorney, Agent, or Firm*—Oblon, Spivak, McClelland, Maier & Neustadt

[57] ABSTRACT

A toner supply device loaded with a removable toner cartridge for supplying a toner to a developing unit of an electrophotographic image forming apparatus. When the toner is fed from the toner cartridge to the toner supply device, an agitating member incorporated in the toner supply device is operated for a predetermined period of time to agitate the toner. The device supplies the toner evenly and rapidly to the developing unit after crushing hard masses of the toner or removing local concentration of the toner which are apt to occur in the cartridge.

3 Claims, 6 Drawing Sheets

DEVICE FOR SUPPLYING A TONER TO A DEVELOPING UNIT

BACKGROUND OF THE INVENTION

The present invention relates to a developing unit incorporated in an electrophotographic image forming apparatus and, more particularly, to a device for supplying a toner to the developing unit.

An electrophotographic copier, facsimile machine, laser beam printer or similar electrophotographic image forming apparatus has a developing unit which is operable with a one-component or a two-component developer. The developer is fed from the developing unit for developing a latent image electrostatically formed on a photoconductive element and representative of a document image. The one-component developer is constituted by a magnetic toner and lacks a carrier, while the two-component developer is made up of a non-magnetic or weakly magnetic toner and a magnetic carrier. The two-component developer is used more frequently than the one-component developer since it promotes easy control over the frictional charging of the toner and has high developability. In any case, the toner is sequentially consumed by the developing unit for development. It is, therefore, necessary to supply a fresh toner smoothly from a toner supply device to the developing unit. The toner supply device is in turn supplied with the toner from a toner cartridge.

A current trend in the image forming art is toward a large size, high speed apparatus. Since such an apparatus consumes a greater amount of toner, or developer, than conventional ones, the developing unit, toner supply device and toner cartridge themselves are increasing in size.

The problem with the toner is that it in nature is apt to form masses due to moisture. Therefore, when a great amount of toner is contained in a large toner cartridge, it is likely that the toner forms large masses in the cartridge or, in some storage conditions, it is locally concentrated in the cartridge and sets there. Should the toner in such a condition be fed from the toner cartridge to the toner supply device, the masses or the local concentration would be directly transferred to the toner supply device to prevent the toner from being fed smoothly from the toner supply device to the developing unit. This would lead to an irregular image density distribution on reproductions. Further, when the toner forms unusually large masses in the toner cartridge, it prevents a closer member or shutter of the cartridge from being returned from an open position to a closed position.

SUMMARY OF THE INVENTION

It is therefore an object of the present invention to provide a toner supply device capable of supplying a toner to a developing unit evenly and rapidly even when the toner fed thereto from a toner cartridge has formed hard masses or has been locally concentrated.

It is another object of the present invention to provide a generally improved device for supplying a toner to a developing unit.

A toner supply device loaded with a removable toner cartridge for supplying a toner to a developing unit of an electrophotographic image forming apparatus of the present invention comprises a casing for storing toner, an agitating member for agitating the toner in the casing, a sensor for sensing that the toner has been fed from the toner cartridge through a shutter of the toner cartridge which is held in an open position, and a controller for controlling the agitating member such that the agitating member operates a predetermined period of time when the sensor has sensed that the toner has been fed from the toner cartridge.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
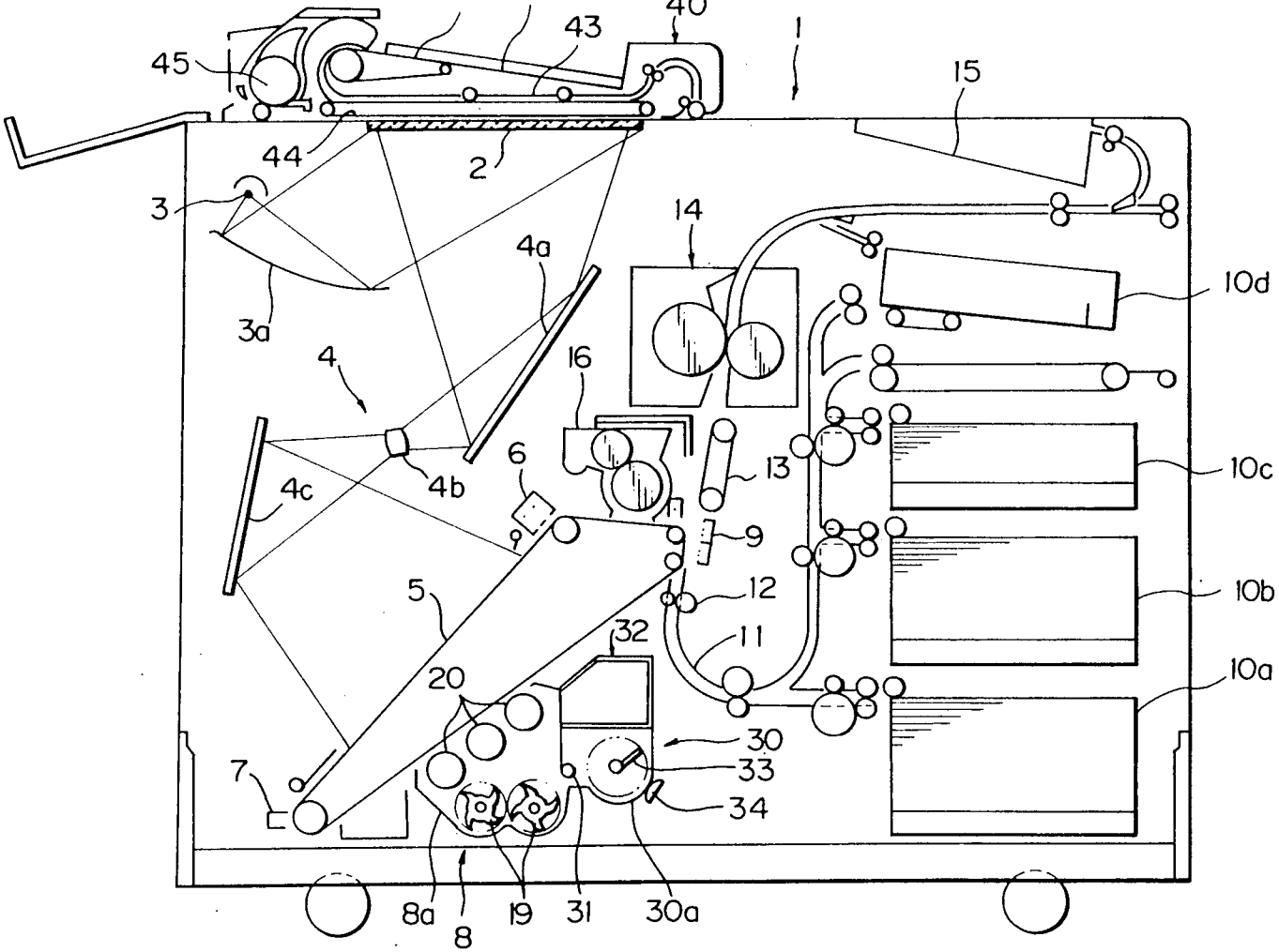
FIG. 1 is a section showing a specific construction of a copier representative of an image forming apparatus to which the present invention is applicable.

Referring to FIG. 1 of the drawings, a copier belonging to a family of image forming apparatuses to which the present invention is applicable is shown. As shown, the copier has a body 1 and an ADF (Automatic Document Feeder) 40. An operation board, not shown, provided on the copier body 1 is accessible for entering desired copying conditions. After the desired copying conditions have been entered, a print button, not shown, will be pressed to cause the copier into a copying operation. The ADF 40 has a document tray 41 on which a stack of documents are loaded face down. A feed belt 42 feeds the documents one by one to a glass platen by way of a transport path 43. On the arrival of the document at the glass platen 2, a lamp 3 emits light while a mirror 3*a* reflects the light toward the document. As a result, the document is illuminated over the entire surface thereof for a predetermined period of time. An imagewise reflection from the document is focused onto a photoconductive belt 5 by optics 4 which is made up of a first mirror 4*a*, a lens 4*b*, and a second mirror 4*c*. The photoconductive belt 5 is uniformly charged by a main charger 6 beforehand. Hence, the imagewise light electrostatically forms a latent image on the belt 5. An eraser 7 removes the charge on the belt 5 except for the latent image, and then a developing unit 8 develops the latent image on the belt 5. The resulting toner image is transferred to a paper sheet by a transfer charger 9 at a predetermined image transfer station. Specifically, a paper sheet is fed from any one of paper trays 10*a*, 10*b* and 10*c* and an intermediate or two-side copy tray 10*d* to a register roller pair 12 via a transport path 11. The register roller pair 12 drives the paper sheet to the image transfer station in synchronism with the toner image. The paper sheet carrying the toner image thereon is moved by a transport belt 13 to a fixing unit 14 to fix the toner image. Finally, the paper sheet or copy is driven out of the copier body 1 to a copy tray 15.

A transport belt 44 transports the document having been illuminated from the glass platen 2 to a discharge roller 45 which then returns it to the document tray 41. The cleaning unit 16 removes the charge and the toner particles which remain on the photoconductive belt 5 after the transfer of the toner image. Thereupon, the main charger 6 charges the belt 5 again to prepare it for another copying cycle.

The developing unit 8 has a casing 8*a* which accommodates a developer consisting of a toner and a carrier or only of a toner, i.e. a two-component or a one-component developer. An agitator 19 is disposed in the casing 8*a* for agitating the developer to provide it with a uniform toner and carrier distribution. The developer is fed to and deposited on developing rollers 20, and then deposited on the latent image on the photoconductive belt 5. As the copying cycle is repeated, the toner in the casing 8*a* is sequentially consumed with the result that the ratio of toner to carrier in the developer, i.e., the toner concentration is sequentially lowered. The decrease in the toner concentration is sensed in terms of, for example, a change in the electric resistance of the developer or a change in the required torque of the agitator 19. In response, a toner supply roller 31 supplies a fresh toner from a toner supply device 30 associated with the developing unit 8 to the casing 8*a* by a predetermined amount at a time. Consequently, the toner concentration in the casing 8*a* is maintained in a predetermined range.

A toner cartridge filled with a toner is removably mounted on the toner supply device 30. A bar 33 is disposed in the toner supply device 30 and serves as an agitating member. The bar 33 agitates the toner in the casing 30*a* at adequate timings to prevent the toner from sticking together and, especially, to distribute it uniformly in the axial direction of the developing rollers 20. A piezoelectric sensor 34 is mounted on a part of a wall 30*a* of the device 30 to constantly sense the amount of toner existing in the device 30. When the piezoelectric sensor 34 senses that the amount of toner remaining in the device 30 has decreased below a predetermined amount, a warning such as a message "TONER END" or "TONER NEAR END" appears on the operation board of the copier body 1. Then, the operator may replace the toner cartridge 32 with new one by opening a cover which is provided on the copier body 1.

Figure 2:
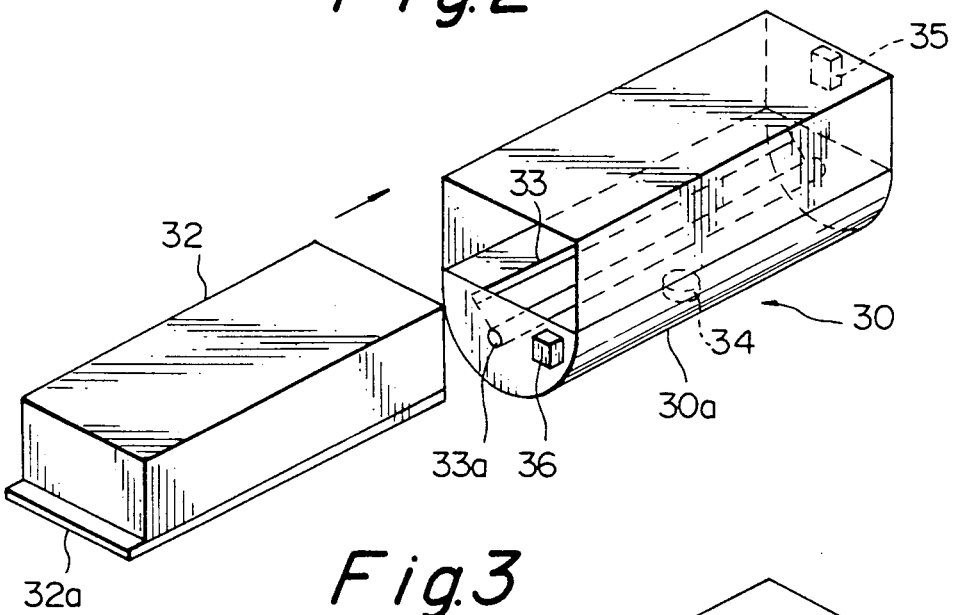
FIGS. 2 to 4 are external perspective views of a toner cartridge usable with a developing unit incorporated in the copier of FIG. 1, showing how the cartridge is replaced.
Figure 3:
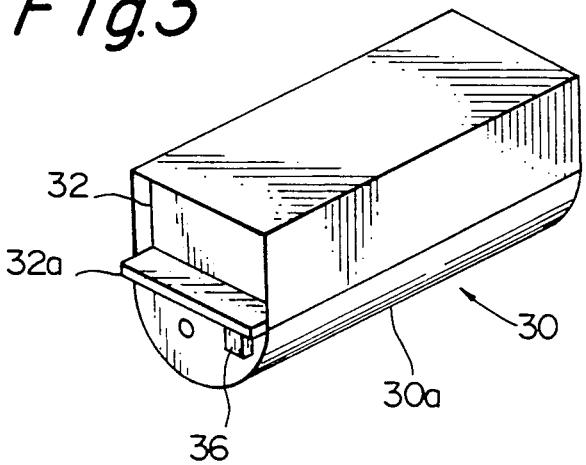
Figure 4:
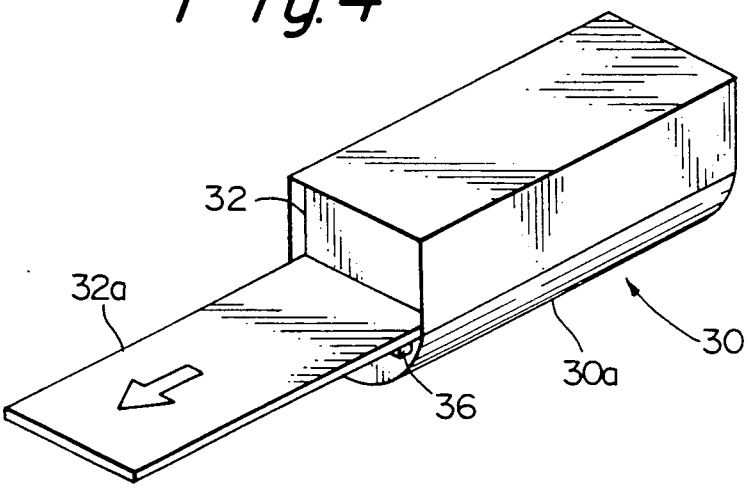

FIGS. 2, 3 and 4 each shows the toner cartridge 32 in a particular condition which occurs during the course of replacement. Specifically, FIG. 2 shows the toner cartridge 32 removed from the toner supply device 30, FIG. 3 shows it inserted in the device 30, and FIG. 4 shows it with a closure member or shutter 32*a* being pulled out from the device 30.

As shown in FIG. 2, the agitating bar 33 is mounted on a shaft 33*a* which is journalled to the toner supply device 30. The piezoelectric sensor 34 is affixed to the bottom of the casing 30*a*. A cartridge sensor 35 is affixed to the inner surface of the innermost wall of the device 30 for sensing the toner cartridge 32. A shutter sensor 36 is located just below an opening (no numeral) through which the toner cartridge 32 may be inserted into the device 30. The shutter sensor 36 is responsive to opening and closing of the shutter 32*a*. Means for sensing the supply of the toner from the toner cartridge 32 to the device 30 is constituted by one or more of the piezoelectric sensor 34, cartridge sensor 35, and shutter sensor 36, as will be described specifically later. The output of the piezoelectric sensor 34 is ON when the amount of toner existing in the device 30 is less than a predetermined amount. The output of the cartridge sensor 35 is ON when the toner cartridge 32 is fully inserted into the device 30. The output of the shutter sensor 36 is ON when the shutter 32*a* is fully opened.

Table 1 shown below indicates the outputs of the individual sensors which appear in a sequence of STEPs 1 to 5 in the event when the toner cartridge 32 is replaced with another due to short toner. In Table 1, the numbers indicated in the column "FIGURE" correspond to FIGS. 2 to 4.

TABLE 1

| STEP | FIGURE NO. | SENSOR 34 | SENSOR 35 | SENSOR 36 |
|---|---|---|---|---|
| [1] BEFORE REPLACEMENT | 3 | ON | ON | OFF |
| [2] BEFORE MOUNTING NEW ONE | 2 | " | OFF | ON |
| [3] AFTER MOUNTING NEW ONE | 3 | " | ON | OFF |
| [4] SHUTTER OPEN | 4 | OFF | " | ON |
| [5] SHUTTER CLOSED | 3 | " | " | OFF |

Figure 5:
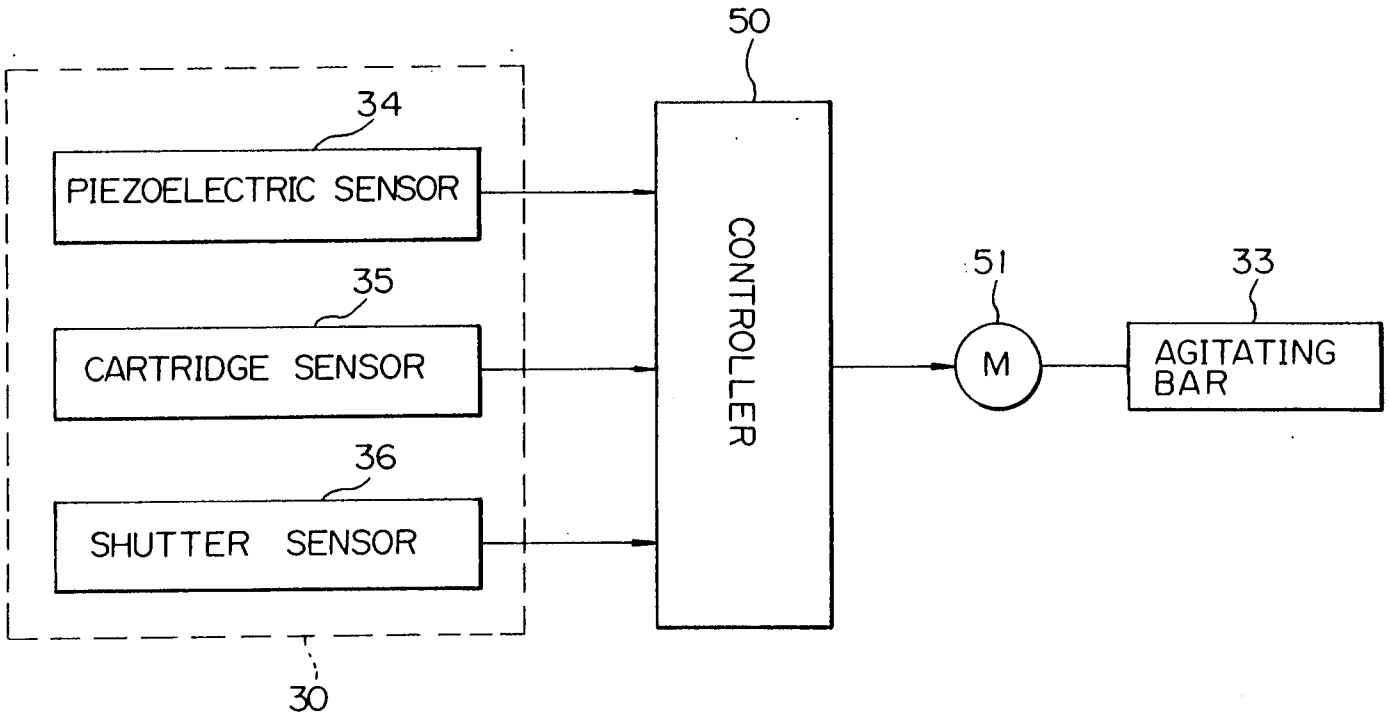
FIG. 5 is a block diagram schematically showing an essential part of a control system associated with the copier of FIG. 1.

FIG. 5 schematically shows a specific construction of a control system for controlling the operation of the agitating bar 33 in response to the outputs of the sensors 34, 35 and 36. The control system has a controller 50 which is implemented with a microcomputer. The controller 50 plays the role of agitation control means and, at the same time, controls the sequence of various sections of the copier. Specifically, the controller 50 energizes a motor 51 for a predetermined period of time in response to the outputs of the piezoelectric sensor 34, cartridge sensor 35 and shutter sensor 36, thereby driving the agitating bar 33 in a rotary motion.

Figure 6:
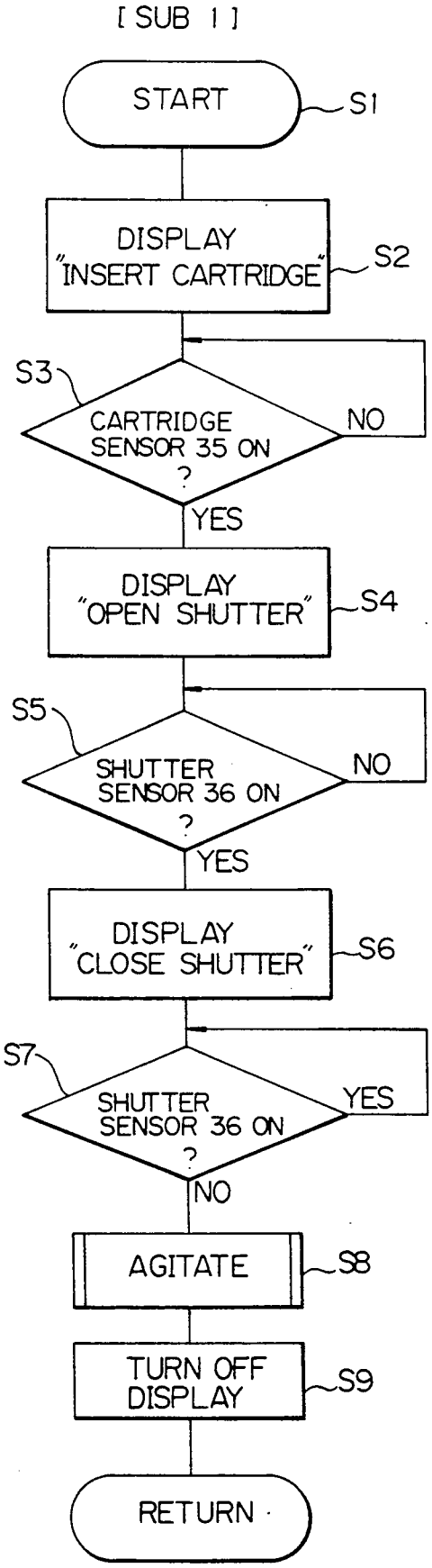
FIGS. 6 to 8 are flowcharts each showing a particular control flow executed by a controller included in the control system of FIG. 5, and representative of preferred embodiments of the present invention.
Figure 7:
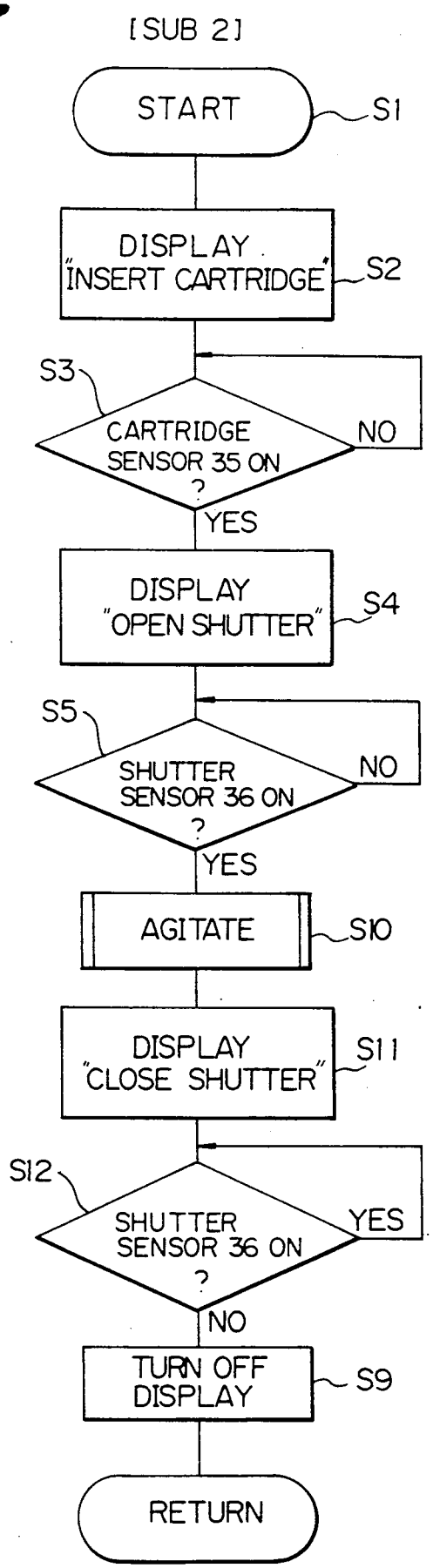
Figure 8:
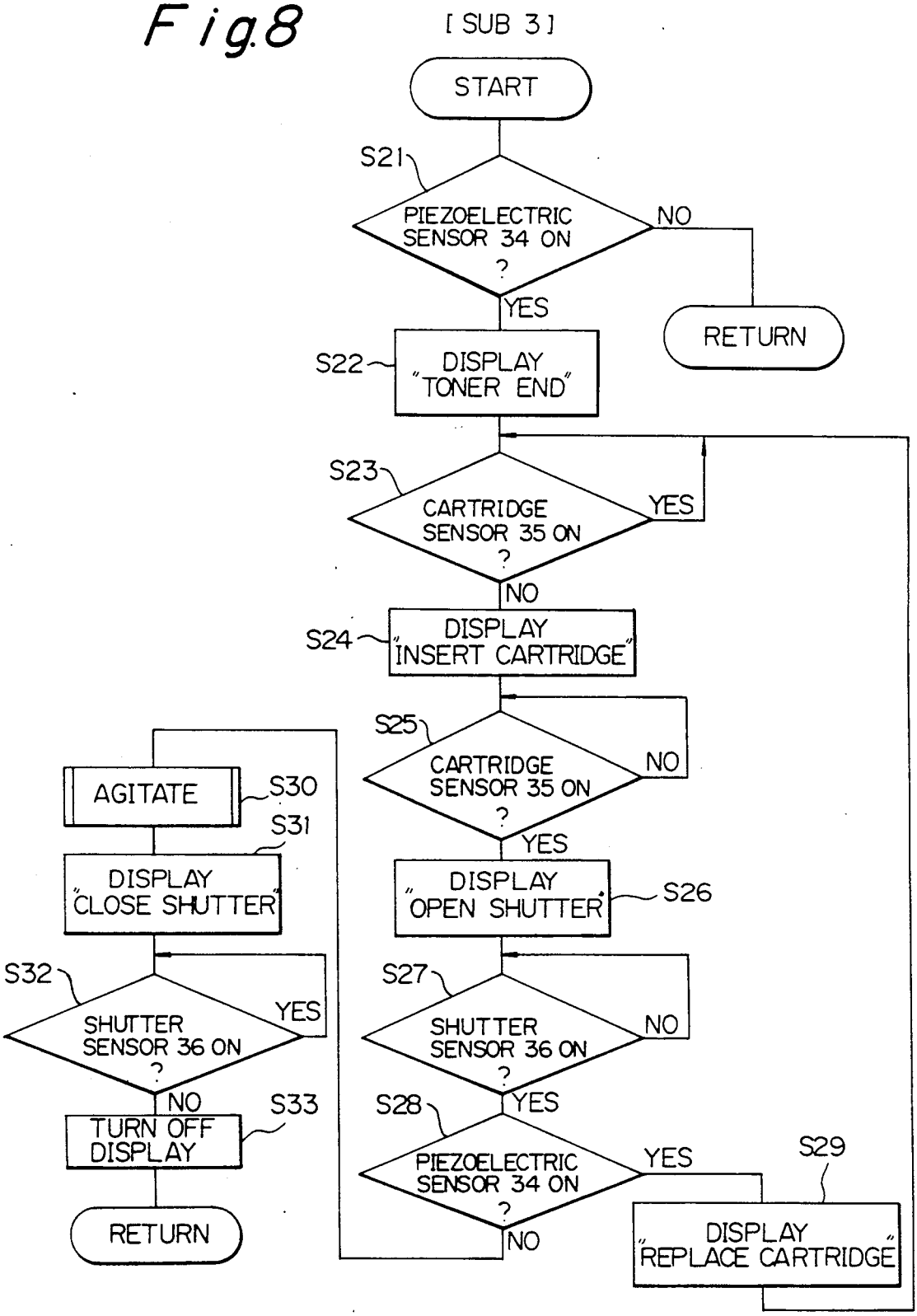

FIGS. 6, 7 and 8 each shows a specific operation of the controller or agitation control means 50 which is representative of a preferred embodiment of the present invention.

Briefly, in the embodiments shown in FIGS. 6 and 7, the supply of the toner is sensed by the combination of the cartridge sensor 35 and shutter sensor 36. Assume that the piezoelectric sensor 34 has sensed the shortage of toner to cause the warning "TONER END" to appear. The cartridge sensor 35 turns from ON to OFF by detecting the removal of the used toner cartridge 32, e.g., in response to the opening of the door of the copier body 1. Then, the operation is transferred from the main routine to a subroutine. FIGS. 6 and 7 each shows a different subroutine.

In FIG. 6, as a subroutine SUB1 begins (step S1), the controller 50 displays a message such as "INSERT NEW CARTRIDGE" and awaits (S2; STEP [2], Table 1). Then, the controller 50 determines whether or not the output of the cartridge sensor 35 has turned from OFF to ON, i.e., whether or not a new cartridge 32 has been inserted (S3). If the answer of the step S3 is YES, the controller 50 displays a message such as "OPEN SHUTTER" and awaits (S4; STEP [3], Table 1). In this condition, the controller 50 determines whether or not the output of the shutter sensor 36 has turned from OFF to ON, i.e., whether or not the shutter 32*a* has been fully opened (S5). If the answer of the step S5 is YES, the controller 50 displays a message such as "CLOSER SHUTTER" and awaits (S6; STEP [4], Table 1). Subsequently, the controller 50 determines whether or not the output of the shutter sensor 36 has turned from ON to OFF, i.e., whether or not the shutter 32*a* has been closed (S7). If the answer of the step S7 is YES, agitation is effected by a subroutine, not shown, (S8). Thereafter, the controller 50 turns off the message (S9) and then returns to the main routine. In the agitation subroutine, not shown, the motor 51, FIG. 5, is energized to agitate the toner for a relatively short period of time or, alternatively, repetitively agitate the toner several times at short intervals over a predetermined period of time in order to prevent it from being scattered around. This agitation subroutine is used not only when the toner cartridge 32 is mounted on the toner supply device 30, but also when the toner is supplied from the device 30 to the developing unit 8.

A subroutine SUB2 shown in FIG. 7 and representative of an alternative embodiment of the present invention is the same as the subroutine SUB1 except that the toner is agitated when the shutter 32*a* is opened and, thereafter, the message "CLOSE SHUTTER" appears (S10 to S12). Agitating the toner before the shutter 32*a* is closed (S10) is advantageous in that, even when the toner is locally concentrated in lumps in the toner cartridge 32, the lumps are crushed before the shutter 32*a* contacts it; otherwise, it is likely that the shutter 32*a* is prevented from being fully closed by the lumps.

FIG. 8 shows a subroutine SUB3 representative of another alternative embodiment of the present invention. The subroutine SUB3 detects the supply of toner in response to the output of the piezoelectric sensor 34. Since the subroutine SUB3 includes a step in which the sensor 34 senses the shortage of toner, the main routine is transferred to the subroutine SUB3 any time while the copier body 1 is in operation.

In FIG. 8, the controller 50 determines whether or not the piezoelectric sensor 34 is ON, i.e., whether or not the toner is short (S21). If the answer of the step S21 is NO, the program immediately returns to the main routine. If the answer of the step S21 is YES, meaning that the toner is short, the controller 50 displays the message "TONER END" or "TONER NEAR END" and awaits the replacement of the toner cartridge 32 (S22; STEP [1], Table 1). Then, the controller 50 determines whether or not the toner cartridge sensor 35 has turned from ON to OFF, i.e., whether or not the used toner cartridge 32 has been removed (S23). If the answer of the step S23 is NO, the controller 50 displays the message "INSERT NEW CARTRIDGE" and awaits (S24; STEP [2], Table 1. The controller 50 determines whether or not the toner cartridge sensor 35 has turned from OFF to ON, i.e., whether or not a new toner cartridge 32 has been inserted (S25). If the answer of the step S25 is YES, the controller 50 displays the message "OPEN SHUTTER" and awaits (S26; STEP [3], Table 1). When the shutter 32*a* is fully opened as represented by the change of the shutter sensor 36 from OFF to ON (S27), the controller 50 determines whether or not the piezoelectric snsor 34 has turned from OFF to ON (S28; STEP [4], Table 1). That the sensor 34 remains ON despite that the shutter 32 has been fully opened means that the operator inadvertently inserted the used toner cartridge 32 or that the toner inside the new toner cartridge 32 has formed hard masses. Then, the controller 50 displays a message "REPLACE CARTRIDGE" (S24) and returns to the step S23. When the piezoelectric sensor is OFF, the operation is transferred to an agitation subroutine (S30). After the step S30, the controller 50 displays a message "CLOSE SHUTTER" and awaits (S31). When the shutter 32*a* is closed as represented by the change of the shutter sensor 36 from ON to OFF (S32; STEP [5], Table 1), the controller 50 turns off the message (S33) and then returns to the main routine.

This embodiment causes the shutter 32*a* to be closed after agitating the tone and, therefore, achieves the same advantages as the embodiment of FIG. 7. Another advantages attainable with this embodiment is that an empty toner cartridge or a toner cartridge whose toner has formed hard masses is excluded to prevent the quality (density) of printings from being lowered. Further, the cartridge sensor 35 and shutter sensor 36 in combination insure the full insertion of a toner cartridge, full opening of the shutter 32*a*, and other expected operations. This is successful in preventing the toner from remaining in the toner cartridge or flowing out of the toner supply device 30 to smear the interior of the copier.

While the present invention has been described in relation to an ordinary copier, it is of course applicable to any other type of image forming apparatus such as a laser printer or similar optical printer, high-speed facsimile machine, or digital copier.

In summary, it will be seen that the present invention provides a toner supply device which, when supplied with a toner with hard masses or a locally concentrated toner from a toner cartridge, immediately restores it to an adequate condition and thereby supplies it to a developing unit evenly and rapidly.

Various modifications will become possible for those skilled in the art after receiving the teachings of the present disclosure without departing from the scope thereof.

What is claimed is:

1. A toner supply device adapted to be loaded with a removable toner cartridge for supplying a toner to a developing unit of an electrophotographic image forming apparatus, comprising:

casing for storing toner;

agitating means for agitating the toner in said casing;

sensing means for sensing loading of the toner cartridge for providing toner to the casing through a shutter of said toner cartridge when held in an open position; and control means for controlling said agitating means such that said agitating means operates for a predetermined period of time sufficient to eliminate concentrated masses of toner when said sensing means has sensed that the toner has been fed from the toner cartridge.

2. A toner supply device loaded with a removable toner cartridge for supplying a toner to a developing unit of an electrophotographic image forming apparatus, comprising:

casing for storing toner;

agitating means agitating the toner in the casing;

sensing means for sensing that the toner has been fed from the toner cartridge through a shutter of said toner cartridge which is held in an open position; and control means for controlling said agitating means such that said agitating means operates for a predetermined period of time when said sensing means has sensed that the toner has been fed from the toner cartridge;

wherein said sensing means comprises at least one of:

a toner amount sensor for sensing an amount of the toner stored in said casing;

a cartridge sensor for sensing the toner cartridge mounted on said device; and a shutter sensor for sensing an open and a closed position of the shutter of the toner cartridge mounted on said device.

3. A device as claimed in claim 2, wherein said control means causes said agitating means to operate for said predetermined period of time in response to outputs of anyone of said toner amount sensor, said cartridge sensor, and said shutter sensor.

* * * * *